US006186685B1

(12) United States Patent
Salemme

(10) Patent No.: US 6,186,685 B1
(45) Date of Patent: Feb. 13, 2001

(54) MARKING INSTRUMENT HOUSING

(75) Inventor: James L. Salemme, Billerica, MA (US)

(73) Assignee: The Gillette Company, Boston, MA (US)

( * ) Notice: Under 35 U.S.C. 154(b), the term of this patent shall be extended for 0 days.

(21) Appl. No.: 09/286,062

(22) Filed: Apr. 5, 1999

(51) Int. Cl.[7] ..... A46B 5/02
(52) U.S. Cl. ..... 401/6
(58) Field of Search ..... 401/6, 88, 207, 401/251; 425/129.1

(56) References Cited

U.S. PATENT DOCUMENTS

D. 359,757 * 6/1995 Inami et al. ..... D19/51
4,380,403 * 4/1983 Endres et al. ..... 401/213
4,558,966 * 12/1985 Mikuteit ..... 401/213
4,985,026 * 1/1991 Kasai et al. ..... 604/403
5,176,460 * 1/1993 Garry ..... 401/202
5,549,404 * 8/1996 Kageyama et al. ..... 401/75
5,977,266 * 11/1999 Reil et al. ..... 525/402
5,988,908 * 11/1999 Kageyama et al. ..... 401/6

* cited by examiner

*Primary Examiner*—Henry J. Recla
*Assistant Examiner*—Peter deVore
(74) *Attorney, Agent, or Firm*—Fish & Richardson P.C.

(57) ABSTRACT

Disclosed is a marking instrument that includes a first body, a second body coupled to the first body, an annular elastomeric sealing member integrally bonded to the first body and forming a watertight seal with the second body, and a marking medium within the marking instrument. The marking instrument having an opening for allowing the marking medium to exit the marking instrument.

15 Claims, 6 Drawing Sheets

MARKING INSTRUMENT HOUSING

BACKGROUND OF THE INVENTION

The invention relates to manufacturing a marking instrument housing.

Housings for marking instruments, such as pens and pencils, vary in design, construction and material. Pen housings, for example, can include one or more components and are often formed from a polymeric material. One common component of a pen housing is generally referred to as a barrel and typically includes a chamber for storing an ink composition.

One challenge in designing pen housings is preventing leakage of the ink composition stored within the housing. The ink composition is often maintained in the pen housing by forming a watertight seal between components of the housing. Watertight seals between two polymeric components can be formed using a variety of methods including, e.g., press fitting the components together, inserting O-rings or gaskets, applying a sealant, or ultrasonically welding a joint between the two components.

SUMMARY OF THE INVENTION

The invention features a housing for use in marking instruments such as pens and pencils.

The invention features a marking instrument that includes: a) a first body, b) a second body coupled to the first body, c) an elastomeric sealing member integrally bonded to the first body, where the elastomeric sealing member forms a watertight seal with the second body, and d) a marking medium disposed within the instrument. The instrument having an opening for allowing the marking medium to exit the instrument. Examples of marking media include ink, graphite, and correction fluid. In one embodiment, the marking media includes titanium dioxide.

In another embodiment, the instrument further includes an elastomeric gripping member integrally bonded to the first body. The gripping member may be in fluid communication with the sealing member. In other embodiments, the gripping member and the sealing member include substantially the same elastomeric material.

In another embodiment, the first body includes a polymer, e.g., polypropylene.

In one embodiment, the sealing member includes an elastomeric material selected from the group consisting of styrene-isoprene-styrene copolymer, styrene-butadienestyrene copolymer, styrene-ethylene-butylene-styrene copolymer, styrene-ethylene-propylene-styrene copolymer and combinations thereof.

In other embodiments, the first body includes a polymeric base and an elastomeric gripping member integrally bonded to the polymeric base. In some embodiments, the first body and the second body are cylindrical. In one embodiment, the first body includes a polymeric base that includes a channel in fluid communication with the sealing member.

In another aspect, the invention features a method of using a marking instrument as described above that includes marking a substrate (e.g., paper) with the marking instrument.

In other aspects, the invention features a method for manufacturing an annular elastomeric sealing member, where the method includes applying an elastomeric composition to the surface of a cylindrical polymeric base that includes a) a channel, and b) an annular groove in fluid communication with the channel, such that the elastomeric composition flows from the channel to the annular groove to form an annular elastomeric member and the elastomeric member is integrally bonded to the polymeric base.

In another aspect, the invention features an article that includes a cylindrical body, and an annular elastomeric sealing member integrally bonded to the body, the sealing member being capable of forming a watertight seal with a second cylindrical body.

In other aspects, the invention features an article that includes a first body, a second body coupled to the first body, and an elastomeric sealing member integrally bonded to the first body, where the elastomeric sealing member forms a watertight seal with the second body.

The invention enables the substantially simultaneous creation and application of an annular elastomeric sealing member, e.g., an O-ring, to a component of a marking instrument housing such that the sealing member is integrally bonded to the component. In addition, the annular sealing member can be applied to the housing component substantially simultaneously with the application of an elastomeric gripping member (i.e., a part of the marking instrument housing that is gripped by the fingers when the marking instrument is used, e.g., as a writing instrument). The invention thus facilitates mass production by eliminating additional process steps such as, e.g., ultrasonic welding, applying an O-ring, or applying a sealant composition, after manufacture of the housing.

The invention also provides a housing that is quickly and easily assembled, which provides further benefits to the mass production of assembled housings and marking instruments that include the housings.

The housing also provides a good watertight seal that is capable of preventing leakage of ink compositions contained therein.

Other features and advantages of the invention will be apparent from the following description of the preferred embodiments thereof, and from the claims.

DESCRIPTION OF THE PREFERRED EMBODIMENTS

Referring to the figures, a marking instrument housing 10 includes a first body in the form of a tapered cylindrical member 12, coupled to a second body in the form of a cylindrical barrel 14. The housing 10 also includes an annular elastomeric sealing member 16 integrally bonded (i.e., directly bonded without the presence of an intervening layer) to the tapered cylindrical member 12.

The tapered cylindrical member 12 and the barrel 14 are constructed such that, when coupled together, a watertight seal is formed at the interface between the annular elastomeric sealing member 16 and the interior surface of the barrel 14.

Figure 3:
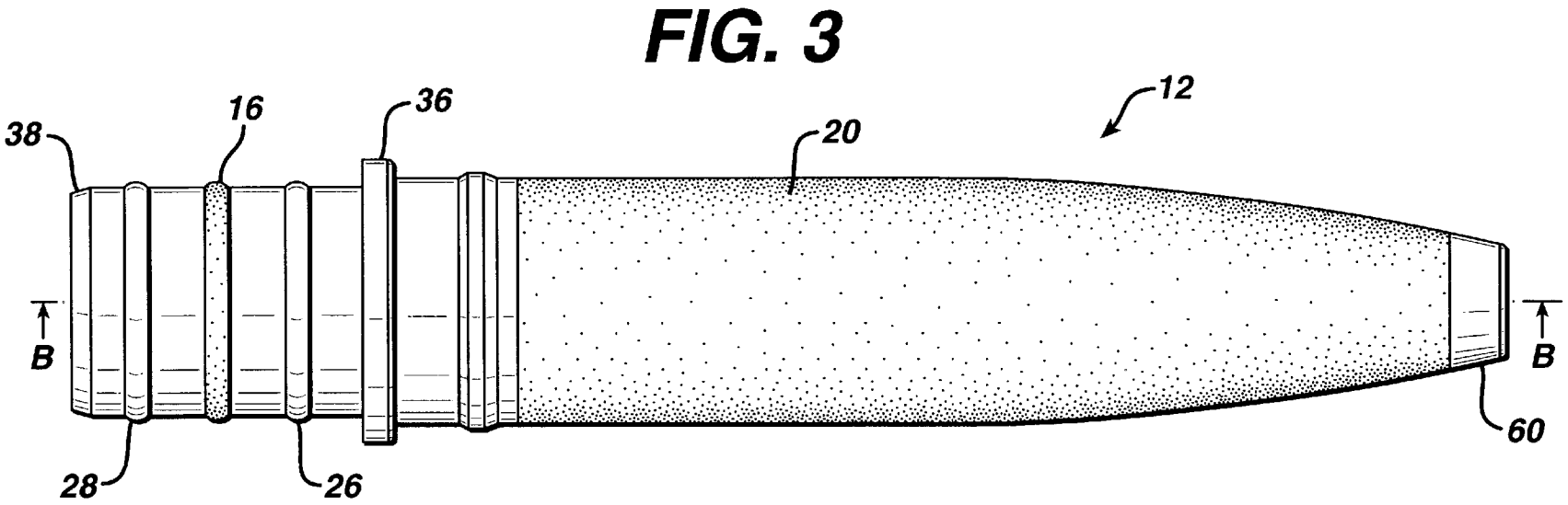
FIG. 3 is a side view of the body of FIG. 2.
Figure 4:
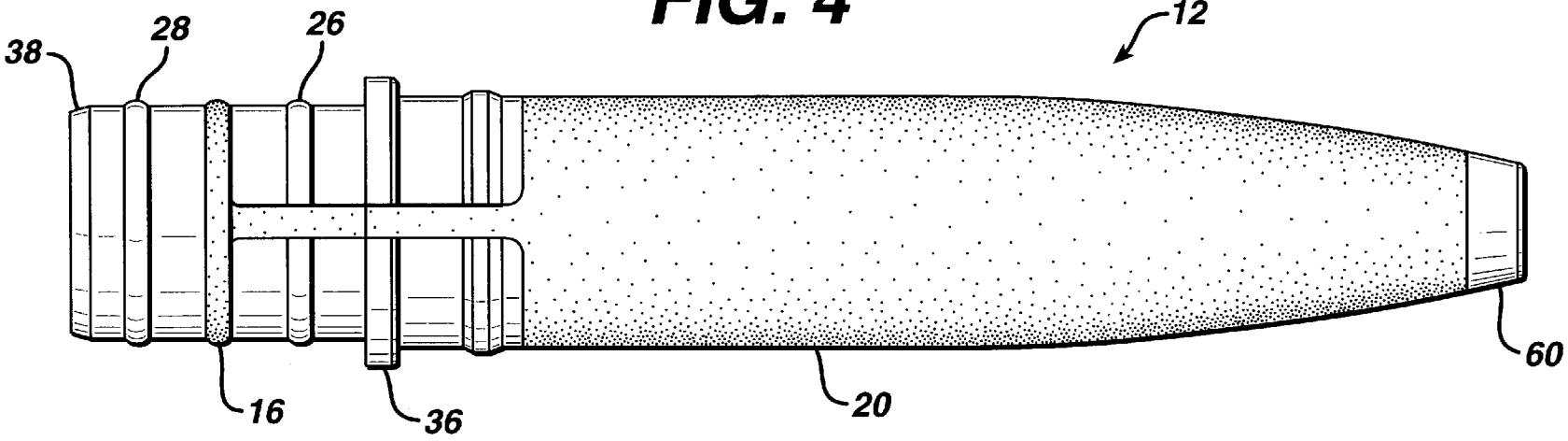
FIG. 4 is a side view of the body of FIG. 3, rotated 90 degrees.
Figure 5:
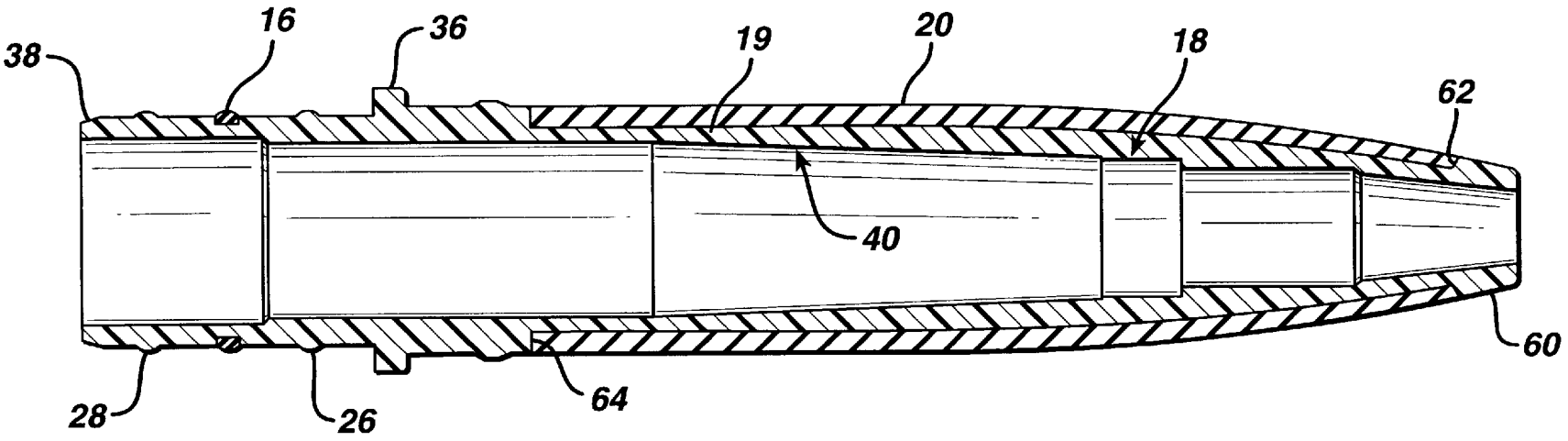
FIG. 5 is a view taken in cross-section along the line B—B of the body of FIG. 4.

Referring to FIGS. 3–5, the tapered cylindrical member 12 includes a polymeric base 18, an elastomeric gripping member 20, and the annular elastomeric sealing member 16. The elastomeric gripping member 20 and the annular elastomeric sealing member 16 are integrally bonded to the polymeric base 18. The polymer of the polymeric base 18 and elastomeric material of the elastomeric members 16 and 20 are selected to integrally bond with each other.

The polymeric base is preferably of a rigid thermoplastic polymer. Examples of a suitable polymers include polypropylene, AB block copolymers, e.g., styrene-isoprene-styrene copolymers and styrene-butadiene-styrene copolymers, polycarbonate, and nylon.

The elastomeric material is preferably a thermoplastic elastomeric material. Preferred elastomeric materials have a Shore A hardness of from about 35 to about 85, more preferably about 35 to about 65, most preferably about 40. Examples of suitable elastomeric materials include, e.g., styrene-ethylene-butylene-styrene copolymers, styrene-ioprene-styrene copolymers, styrene-butadiene-styrene copolymers, styrene-ethylene-propylene-styrene copolymers, and combinations thereof.

Figure 6:
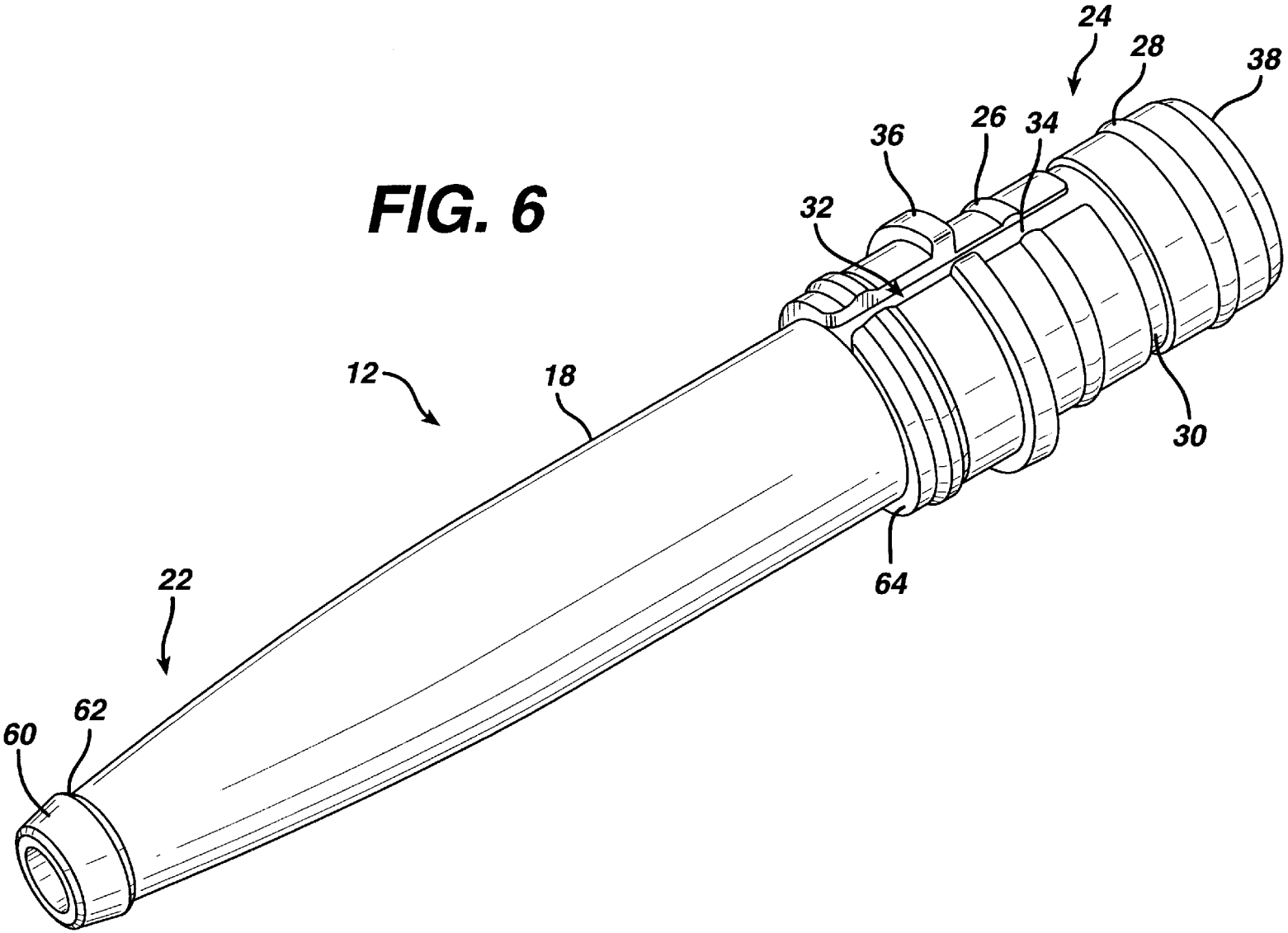
FIG. 6 is a perspective view of the polymeric base of the tapered cylindrical body of FIG. 2.

Referring to FIGS. 5 and 6, the polymeric base 18 is generally a hollow cylindrical body defined by a wall 19 and terminating in a first tapered frustoconical end portion 22, and a second generally cylindrical input end portion 24. Polymeric base 18, including frustoconical end portion 22 and input end portion 24, is preferably circular in cross-section. The frustoconical end portion 22 and the input end portion 24 are open such that the interior surface 40 of wall 19 defines a passageway through polymeric base 18.

Input end portion 24 includes a first annular ring 26, a second annular ring 28, and an annular groove 30 disposed between the first and second annular rings 26, 28, as shown in FIG. 6. During the molding process, both channels work together to provide a path over which the elastomeric material can flow. Annular rings 26 and 28 assist in retaining input end portion 24 within the receiving portion of barrel 14 when the two bodies 12, 14 of the housing 10 are coupled together, as described below in more detail.

Input end portion 24 also includes two channels, preferably identical in shape and dimension and spaced 180° from each other along the circumference of the cylindrical wall of the input end portion 24. One channel 32 is shown in FIG. 6. The second channel (not shown) is located 180° from channel 32. The channels 32 pass through a portion of input end portion 24, including annular ring 26, and empty into the annular groove 30. The two channels thus bisect first annular ring 26; one point of intersection is indicated at point 34 on FIG. 6. Input end portion 24 also preferably includes a tapered edge 38 to facilitate the coupling of tapered cylindrical member 12 with barrel 14, as described below in more detail.

The frustoconical end portion 22 of the polymeric base 18 includes an annular frustoconical tip portion 60 defined by an annular frustoconical wall 62, as shown in FIG. 6.

Elastomeric gripping member 20 extends from side wall of annular wall 62, to side wall 64 of input end portion 24 on frustoconical end portion 22. The elastomeric material of the elastomeric gripping member 20 is also present in the channels 32 of input portion 24 and in annular groove 30, where it forms annular elastomeric sealing member 16.

Annular elastomeric sealing member 16 protrudes from the exterior surface of wall 19 of polymeric base 18 so as to provide a positive relief on the surface of polymeric base 18.

Tapered cylindrical member 12 is formed by overmolding an elastomeric composition onto a polymeric base. During manufacture, liquid elastomeric material is injected into a mold cavity containing the polymeric base 18. The elastomeric material then flows into a volume in the mold that defines the gripping member 20, and through one or more channels e.g., channel 32, to annular groove 30, whereupon it fills channel 32 (as wells as the channel that is not shown) and annular groove 30, thereby forming contiguous annular elastomeric sealing member 16 around the circumference of the tapered cylindrical member.

Figure 1:
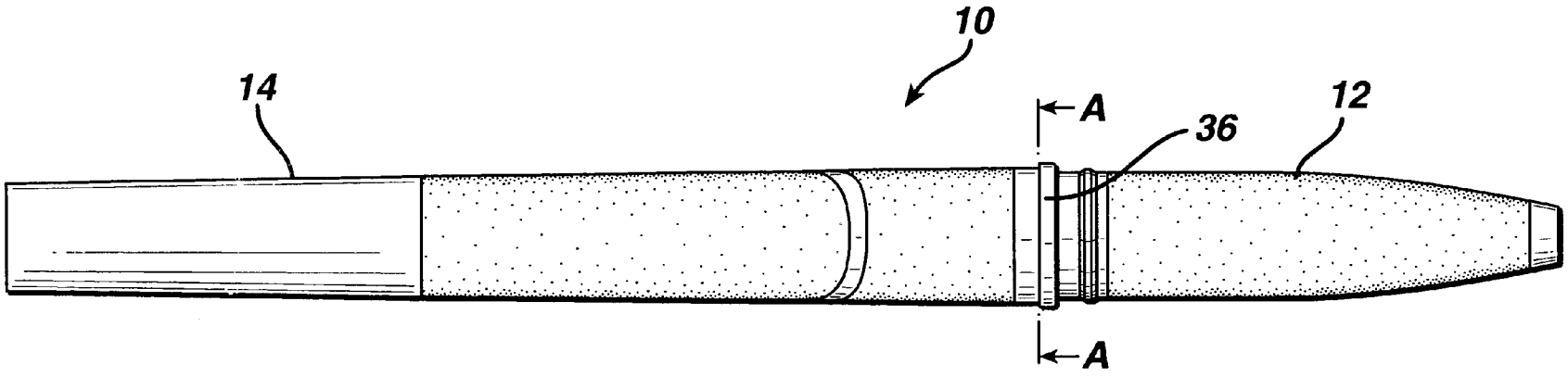
FIG. 1 is a side view of a housing according to one embodiment of the invention.
Figure 7:
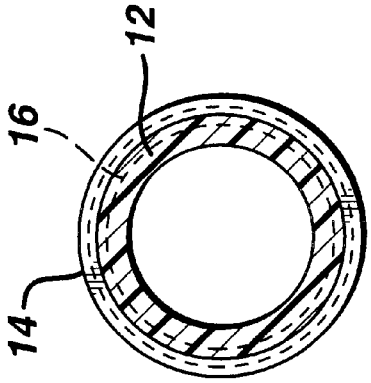
FIG. 7 is a view taken in cross-section along line A—A of the housing of FIG. 1.
Figure 2:
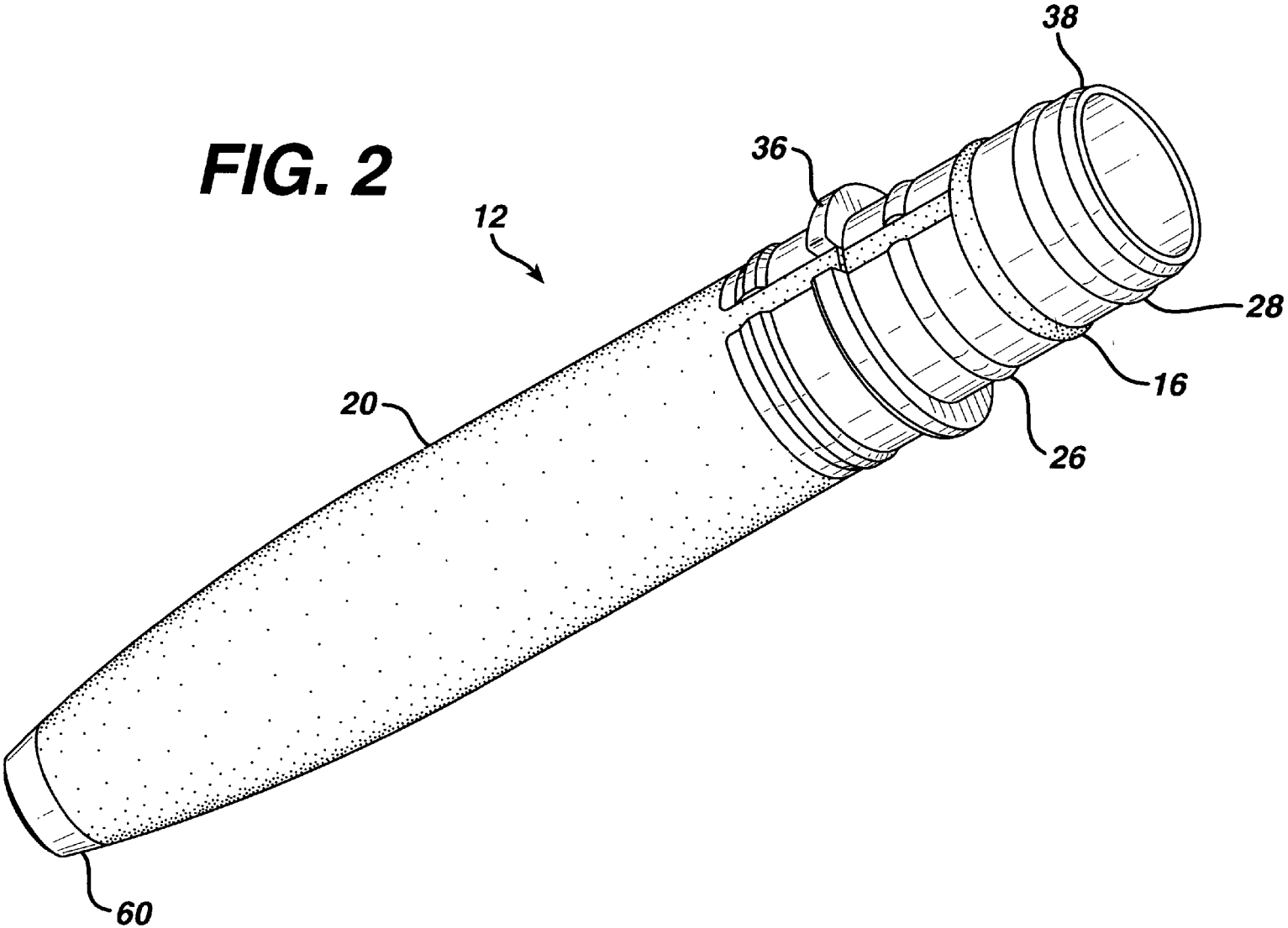
FIG. 2 is a perspective view of the tapered cylindrical body of the housing of FIG. 1.
Figure 8:
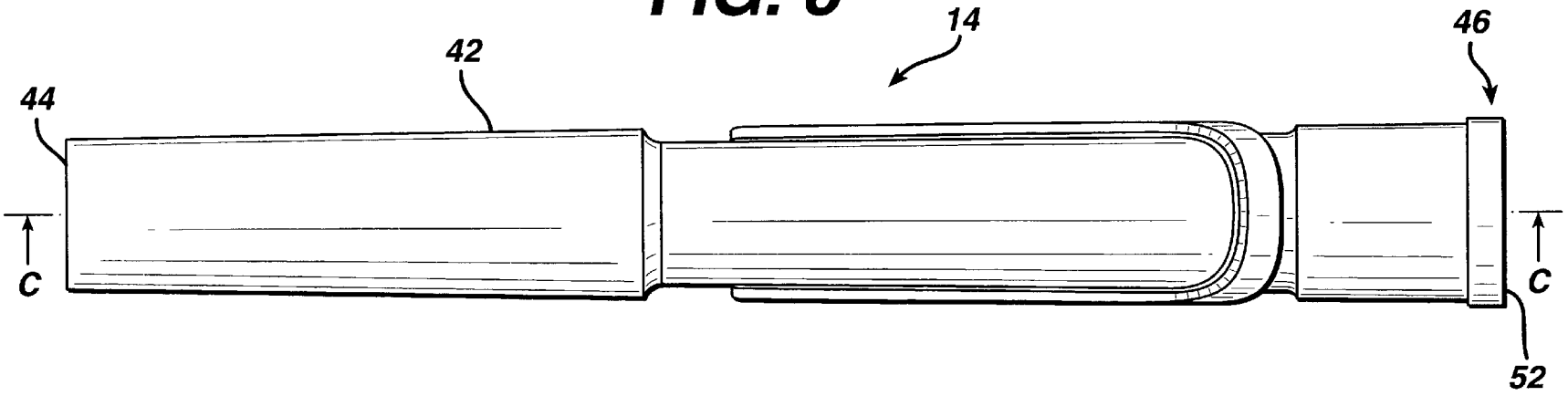
FIG. 8 is a side view of the barrel of the housing of FIG. 1.
Figure 9:
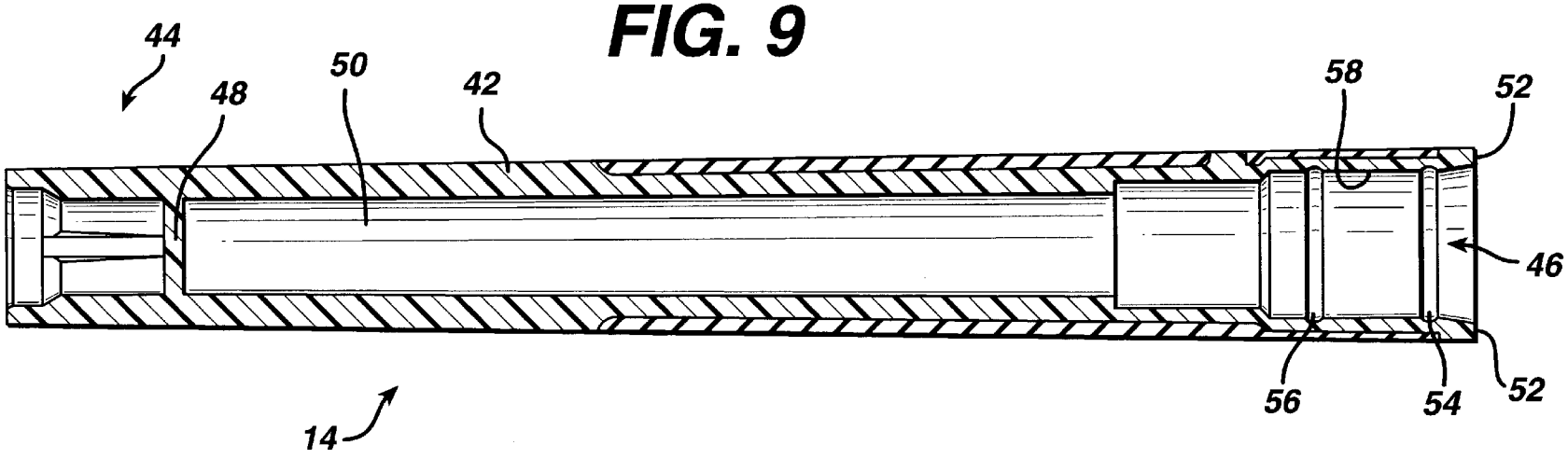
FIG. 9 is a view taken in cross-section along the line C—C of the barrel of FIG. 8.

The barrel 14 of the housing 10 is defined by a cylindrically shaped wall 42, preferably circular in cross-section, which has a generally cylindrically shaped inner surface, as shown in FIGS. 1, 8 and 9. Barrel 14 terminates in a first open receiving end portion 46 that has a generally circular cross-section. The receiving end portion 46 is dimensioned to receive the input portion 24 of tapered cylindrical member 12.

The inner surface 58 of wall 42 at receiving end portion 46 of barrel 14 includes a first annular groove 54 extending into the cylindrical wall 42 and a second annular groove 56 spaced apart from the first annular groove 54 and extending into cylindrical wall 42 of the barrel 14.

Preferably the interior diameter of barrel 14 at first groove 54 is slightly greater than the exterior diameter of annular ring 28 of input end portion 24, and the interior diameter of barrel 14 at second groove 56 is slightly greater than the exterior diameter of second annular ring 28.

Input end portion 24 of tapered cylindrical member 12 is dimensioned to fit within and engage receiving portion 46 of barrel 14 when receiving portion 46 and input end portion 24 of the tapered cylindrical member 12 are moved into engagement with each other. The interfitting of input end portion 24 of tapered cylindrical member 12 and receiving portion 46 of barrel 14 mechanically fastens tapered cylindrical member 12 to barrel 14, thereby providing a press fit housing assembly 10.

In particular, input end portion 24 of tapered cylindrical member 12 is inserted into the receiving portion 46 of the barrel 14. The inward movement of tapered cylindrical member 12 is limited when the transversely projecting annular shoulder 36 on the input end portion 24 is brought into abutment with the edge surface 52 of receiving end 46 of the barrel 14, as shown in FIG. 1.

In addition, when the input portion 24 of tapered cylindrical member 12 is pressed inwardly toward the receiving end 46 of barrel 14, annular ring 28 and elastomeric sealing member 16 ride past barrel groove 54, and annular rings 28 and 26 move into interfitting engagement with barrel grooves 56 and 54, respectively, to form a press fit assembly 10. Meanwhile, elastomeric sealing member 16, which has an exterior diameter that is slightly greater than the interior diameter of the area of the receiving portion that contacts the sealing member 16, presses against the interior surface 58 of the cylindrical wall 42 forming a watertight seal therewith.

The barrel 14 also terminates in a second end portion 44. At or near second end portion 44, an end wall 48 meets cylindrically shaped wall 42 to define an inner chamber 50. The inner chamber 50 of barrel 14 can house a fluid, e.g., an ink. The fluid can be in any form including, e.g., a liquid composition, a fluid reservoir dimensioned to fit in the inner chamber 50 of the barrel 14, or a fibrous material saturated with a liquid composition.

The marking instrument is useful for marking a substrate (e.g., paper) and includes a marking medium (i.e., a medium capable of imparting a mark to a substrate) such as e.g., ink or graphite (e.g, pencil lead). The marking instrument can be in the form of, e.g., a pen, a highlighter, a marker, a pencil, or an instrument for covering an existing mark, e.g., the marking instrument can include a correction fluid (e.g., a titanium dioxide composition).

Other embodiments are within the claims. For example, although the housing has been described as containing two annular rings for assisting a press fit relationship between the tapered cylindrical member and the barrel, one or more annular rings and corresponding grooves can be employed in the tapered cylindrical member and barrel, respectively. In addition, any number of channels can be used to provide fluid communication between the annular elastomeric sealing member and the gripping member, provided the press fit performance and the sealing performance of the housing are maintained at a desired level.

The housing can also include one or more elastomeric sealing members having a variety of dimensions providing at least one sealing member forms a watertight seal with the barrel. In other embodiments, the housing includes two closed ends.

The housing may also house a variety of liquid compositions such as, e.g., cosmetic compositions (e.g., lotion, foundation, blush, eye shadow, mascara, and eye liner), polish (e.g., nail polish), bleaching compositions, sealing compositions (e.g., epoxy-based and acrylate-based compositions), and adhesive compositions.

What is claimed is:

1. A marking instrument comprising:

a first barrel member;

a second barrel member coupled to said first barrel member;

said first and second barrel members together defining a marking instrument body;

an elastomeric sealing member bonded to said first barrel member, said elastomeric sealing member forming a watertight seal with said second barrel member, an elastomeric gripping member disposed on an exposed surface of said first barrel member to provide a gripping surface constructed to be gripped by a user during use of the writing instrument, said first barrel member comprising a polymeric base that includes a channel in fluid communication between the sealing member and the gripping member;

said elastomeric gripping member being separate from said elastomeric sealing member said sealing member and said gripping member being made integral by a connecting elastomeric member in said channel, and a marking medium disposed within said instrument, said instrument having an opening for allowing said marking medium to exit said instrument.

2. The instrument of claim 1 wherein said gripping member is in fluid communication with said sealing member.

3. The instrument of claim 1 wherein said gripping member and said sealing member comprise substantially the same elastomeric material.

4. The instrument of claim 1 wherein said first barrel comprises a polymer.

5. The instrument of claim 1, wherein said first barrel comprises polypropylene.

6. The instrument of claim 5, wherein said sealing member comprises an elastomeric material selected from the group consisting of styrene-isoprene-styrene copolymer, styrene-butadiene-styrene copolymer, styrene-ethylene-butylene-styrene copolymer, styrene-ethylene-propylene-styrene copolymer and combinations thereof.

7. The instrument of claim 1, wherein said sealing member comprises an elastomeric material selected from the group comprises an elastomeric material selected from the group consisting of styrene-isoprene-styrene copolymer, styrene-butadiene-styrene copolymer, styrene-ethylene-butylene-styrene copolymer, styrene-ethylene-propylene-styrene copolymer and combinations thereof.

8. The instrument of claim 1, wherein said first barrel comprises a polymeric base and said elastomeric gripping member is integrally bonded to said polymeric base.

9. The instrument of claim 1, wherein said first barrel and said second body are cylindrical.

10. The instrument of claim 1, wherein said marking medium comprises ink.

11. The instrument of claim 1, wherein said marking medium comprises graphite.

12. The instrument of claim 1, wherein said marking medium comprises correction fluid.

13. The instrument of claim 1, wherein said marking medium comprises titanium dioxide.

14. A method of marking a substrate with a marking instrument comprising:

forming a marking on the substrate with a marking instrument comprising a first barrel member, a second barrel member coupled to said first barrel member, said first and second barrel members together defining a marking instrument body, an elastomeric sealing member bonded to said first barrel member, said elastomeric sealing member forming a watertight seal with said second barrel member, an elastomeric gripping member disposed on an exposed surface of said first barrel member to provide a gripping surface constructed to be gripped by a user during use of the writing instrument, said first barrel member comprising a polymeric base that includes a channel in fluid communication between the sealing member and the gripping member, said elastomeric gripping member being separate from said elastomeric sealing member, said sealing member and said gripping member being made integral by a connecting elastomeric member in said channel, and a marking medium disposed within said instrument, said instrument having an opening for allowing said marking medium to exit said instrument, while gripping the gripping surface of the marking instrument.

15. The method of claim 14, wherein said substrate comprises paper.

* * * * *